US006662472B1

(12) United States Patent
Hsu

(10) Patent No.: US 6,662,472 B1
(45) Date of Patent: Dec. 16, 2003

(54) BUFFER DEVICE OF SPORTS SHOES

(75) Inventor: Chia-Chi Hsu, Yun-Lin Hsien (TW)

(73) Assignee: Feng Tay Enterprise Co., Ltd., Yun-Lin Hsien (TW)

( * ) Notice: Subject to any disclaimer, the term of this patent is extended or adjusted under 35 U.S.C. 154(b) by 0 days.

(21) Appl. No.: 10/231,100

(22) Filed: Aug. 30, 2002

(51) Int. Cl.[7] ..... A43B 13/20
(52) U.S. Cl. ..... 36/29; 36/35 R
(58) Field of Search ..... 36/28, 27, 29, 36/35 R, 3 B

(56) References Cited

U.S. PATENT DOCUMENTS 3,716,930 A * 2/1973 Brahm ..... 36/3 B
5,222,312 A * 6/1993 Doyle ..... 36/28
5,343,639 A * 9/1994 Kilgore et al. ..... 36/29
5,477,626 A * 12/1995 Kwon ..... 36/3 B
5,537,762 A * 7/1996 Walters ..... 36/28

FOREIGN PATENT DOCUMENTS

EP 630592 * 12/1994

* cited by examiner

*Primary Examiner*—Ted Kavanaugh
(74) *Attorney, Agent, or Firm*—Troxell Law Office PLLC

(57) ABSTRACT

The present invention relates to a buffer device of sport shoes having a plurality of air chamber buffer elements disposed at the appropriate positions on the sole of the shoes, and a ventilation tube of each air chamber buffer element is connected to an air bag on which an air valve is fixed for supplying air from outside. When the air in the air bag and each of the air chamber buffer elements is saturated, the pressure in the air bag and each air chamber buffer element reaches equilibrium, such that the internal air pressure of the air bag or the air chamber buffer element is compressed by the feet and the air is pressed into the air bag or any one of the air chamber buffer elements, and thus attains the effect of elastic buffering for the feet. The air can be refilled any time by the user's wearing the shoes and walking after the air leaks to the outside.

2 Claims, 3 Drawing Sheets

BUFFER DEVICE OF SPORTS SHOES

BACKGROUND OF THE INVENTION

1. Field of the Invention

The present invention relates to an improved buffer device of sports shoes, more particularly to an improved buffer device having a plurality of air chamber buffer elements and an air bag which are connected with each other, and are disposed at the appropriate positions on the sole of the shoes; when the air chamber buffer element and the air bag are compressed by the wearer's foot, the valve nozzle of the air bag is in closed status to avoid air leakage. As the foot releases the compression of the air chamber buffer element and the air bag, the air chamber buffer elements and air bag resume their original shape, and in the meanwhile, the external air is absorbed automatically from the valve nozzle into the air bag and air chamber buffer elements until they reach the saturated status such that the sports shoes can have the buffering effect all the time. If the pressure is reduced gradually due to air leakage, the air pressure can also be supplemented at any time, so that the sports shoes attain the function of automatically supplying air pressure and preventing the disabling of the buffering function due to the leakage.

2. Description of the Prior Art

In general, traditional sports shoes with buffering function are divided into two common types according to the structure of the sole; they are the one with spring and the one with air bag, or simply by using an elastic element with higher elasticity for the buffering effect of the sports shoes. However, the aforementioned types have the following shortcomings:

1. The shortcomings of using springs:
   a. Since the spring is compressed by the feet frequently, the elasticity of spring will be exhausted, and thus losing the buffering effect.
   b. The extent of compression by the spring is limited. Once force is exerted, the spring is compressed to its limit, and the buffering effect is very insignificant.
   c. If a spring is chosen for enhancing the elastic effect, the relative reaction is increased, and thus easily causes physical injury to the wearer.
2. The shortcomings of using air bags:
   The air bag should be filled with air until it reaches saturated status, and then placed inside the sole of the sports shoes. The buffering effect is unquestionable, but no matter how airtight it is, it still has capillaries. After wearing the shoes for a period of time, the air bag will gradually have leakage so that the air bag will collapse and then lose the buffering effect.
3. The shortcomings of using elastic elements:
   If only the elastic elements such as rubber lump, foaming body, or soft plastic are installed at the position of the sole, its buffering effect is far below that, for the aforementioned air bag, and when the shoes are under heavy load for a long time, the material will deform for sure.

In view of the shortcomings of the prior art mentioned above, the inventor of the present invention based on years of experience accumulated from the engagement in the related industry conducted extensive research to resolve the foregoing shortcomings and invented the present invention.

SUMMARY OF THE INVENTION

Therefore, the primary objective of the present invention is to provide an improved buffer device of sports shoes, wherein the buffer structure is installed at the appropriate position on the sole of the sports shoes, which is composed of a plurality of air chambers and an air bag. Each air chamber buffer element is connected to the air bag by an air tube so that when the wearer's foot compresses the air chamber buffer element and the air bag, the shoes can have better buffering effect; in the meantime, a valve nozzle is connected to the air bag. By means of the incoming air of the valve nozzle, the air chambers and air bag are compressed, and when they resume back to their original positions, the air outside will be absorbed into the air bag and air chamber buffer element through the valve nozzle until they reach the saturated status and then stops absorbing air. Thus, such arrangement enhances the buffering effect of the sports shoes.

The secondary objective of the present invention is to provide an improved buffer device of sports shoes; wherein the air chamber buffer element is composed of an inner tube and an outer tube, and an outer air chamber if formed between the inner tube and the outer tube, and an inner air chamber is disposed in the middle of the inner tube. The inner air chamber and the outer air chamber are connected by an airway hole, and a ventilation tube on the external air chamber is connected to the air bag such that the air bag, inner air chamber, and outer air chamber are connected with each other. If any of the air chamber buffer elements or air bags is compressed, it will influence the pressure of all other air chamber buffer elements and air bags and will reach a saturated and equilibrium status in order to enhance the buffering and balancing effect of the sports shoes at all positions.

To make it easier for our examiner to understand the objective of the invention, structure, innovative features, and performance, we use a preferred embodiment together with the attached drawings for the detailed description of the invention.

BRIEF DESCRIPTION OF THE DRAWINGS

Other objects, features, and advantages of the invention will become apparent from the following detailed description of the preferred but non-limiting embodiment. The description is made with reference to the accompanying drawings, in which.

DETAILED DESCRIPTION OF THE PREFERRED EMBODIMENT

Figure 1:
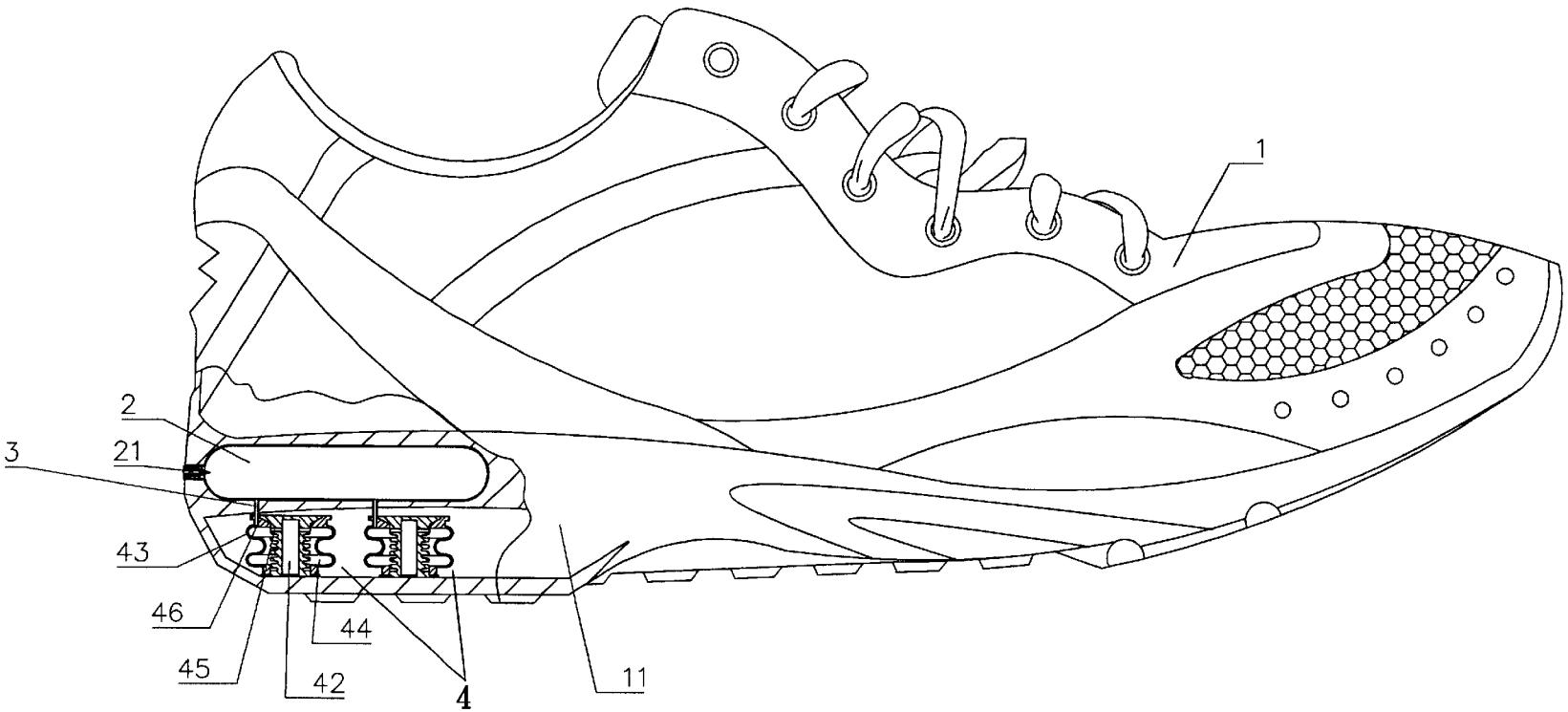
FIG. 1 is a schematic diagram of the assembly of the present invention.
Figure 4:
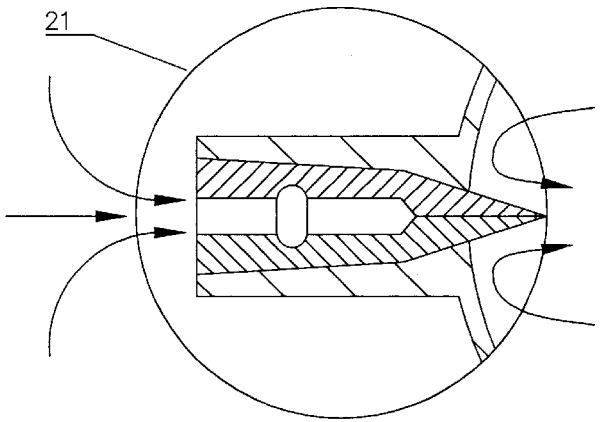
FIG. 4 is the schematic diagram of the valve nozzle on the air bag of the present invention.
Figure 2:
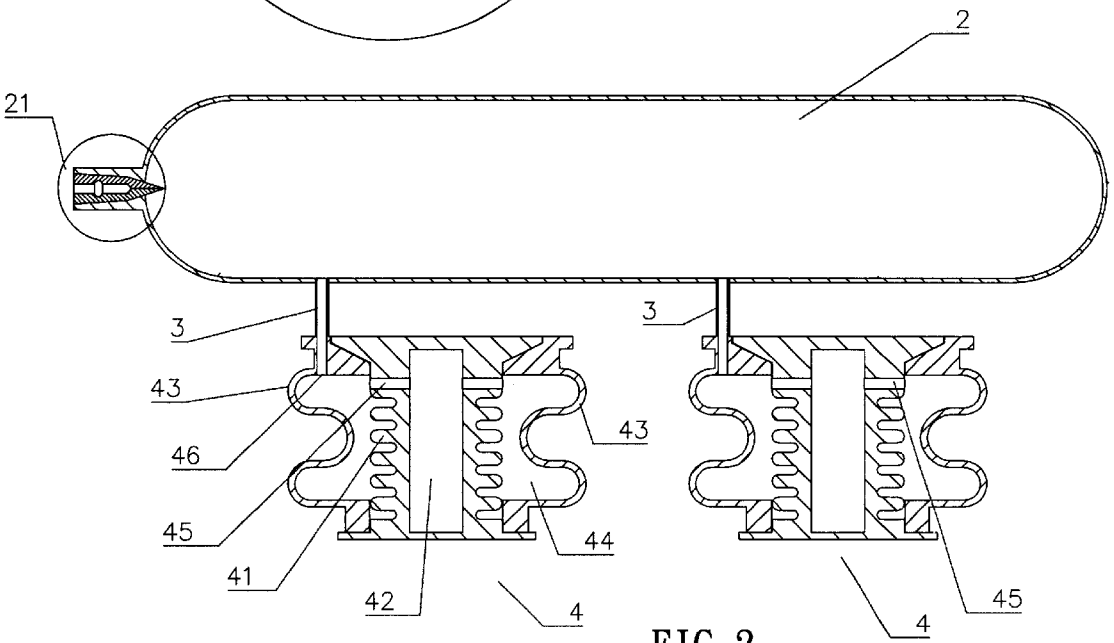
FIG. 2 is a schematic diagram of the enlargement of the buffering structure of the present invention.
Figure 3:
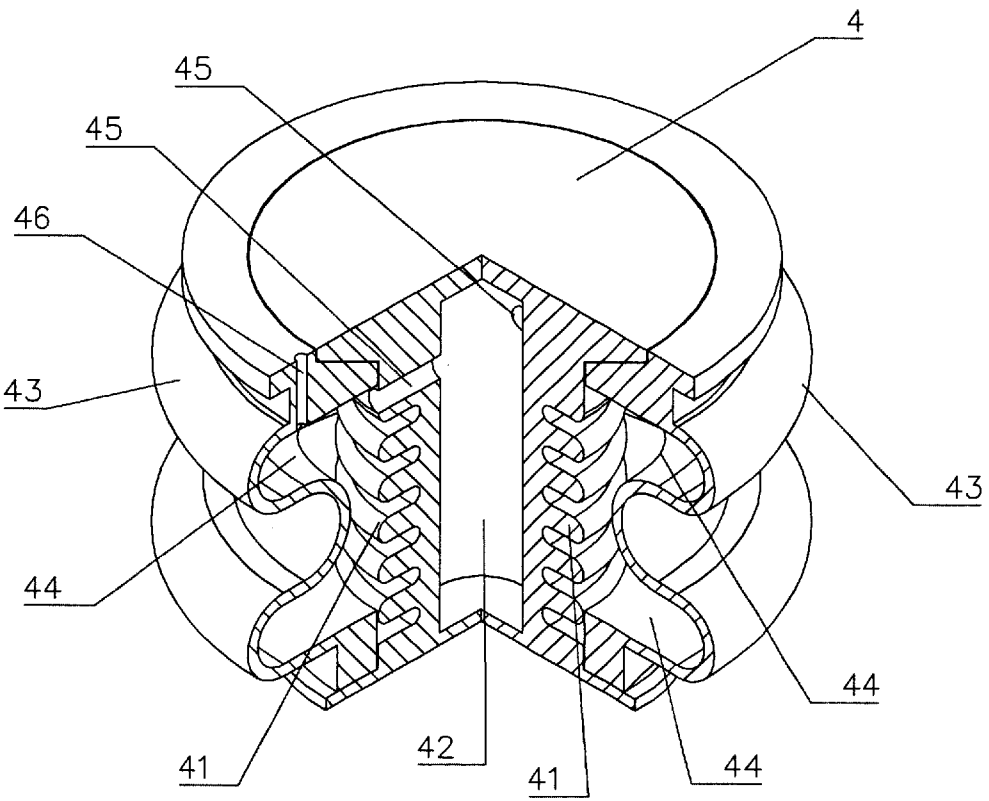
FIG. 3 is a cross-sectional diagram of air chamber buffer element of the present invention.

Please refer to FIGS. 1 to 3. A plurality of air chamber buffer element 4 and an air bag 2 are installed at the appropriate positions of the sole 11 of the sports shoe 1; the air chamber buffer element 4 is fixed from the inner tube 41 to the outer tube 43 such that an inner air chamber 42 is formed inside the inner tube 41, and an outer air chamber 44 is formed between the inner tube 41 and the outer tube 43. An airway hole 45 is disposed between the inner air chamber 42 and the outer air chamber 44. In the meantime, a ventilation opening 46 is disposed on an appropriate position of the outer air chamber 44. An airway tube 3 is used to connect the ventilation opening 46 and extended to connect the air bag 2 such that the outer air chamber 44 and the air bag 2 are connected with each other. A valve nozzle 21 (as shown in FIG. 4) is internally connected to the air bag 2 so that the outside air may enter into the air bag through the valve nozzle 21, but unable to leak from the valve nozzle 21.

When the wearer's foot presses onto the air bag 2 or the air chamber buffer element, the foot obtains a safe buffering effect and avoids the ankle from being hit or injured. Since the air inside the air bag 2 and air chamber buffer element 4 will gradually leak to the outside as the sports shoes have been put aside for a period of time, so that there is insufficient air pressure in the air bag 2 and the air chamber buffer element 4, and thus is unable to have the buffering effect. Therefore, if the air bag 2 and the air chamber buffer element 4 are compressed, the air bag 2 and the air chamber buffer element 4 resume their original positions when the foot is lifted to release the compression. In the meantime, the resumability of the highly elastic inner tube 41 of the air chamber buffer element 4 is used to absorb the outside air by the valve nozzle 21 of the air bag 2. Such compression and resumption are repeated until the air pressure inside the air bag 2 and the air chamber buffer element 4 reaches the saturated status so that the sport shoes can have the buffering effect for sure. After the pressure is released, such arrangement offers a repeated use and resumes the pressure to its saturation, such that the sports shoes at any time and any where can have the effect of automatically refilling the air to its saturated status without using additional air supplying device or having the risk of air leakage.

Therefore, in summation of the above description, the present invention makes use of the resumability after the highly elastic compression to absorb air from the valve nozzle until the air pressure in the air bag and the air chamber buffer element reaches the saturated status, which can enhance the buffering effect of the sports shoes to improve the utilization of the prior art product. The present invention definitely meets the requirements of patentability, which is hereby submitted for patent application. While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A buffering device of sports shoes, having a buffer structure and an air bag, each disposed at an appropriate position on the sole of the sport shoes to enhance its buffering effect; characterized in that said buffering device comprising:

a plurality of air chamber buffer elements, each being fixed by an inner tube to an outer tube thereby an inner air chamber being formed in the inner tube, and an outer air chamber being formed between the inner tube and the outer tube; an airway hole being disposed between the inner chamber and the outer chamber and connecting the inner chamber and the outer chamber; a ventilation opening being disposed at an appropriate position of the outer air chamber, and a ventilation tube connecting to the ventilation opening and extending to connect to the air bag thereby each of the air chamber buffer elements and air bag being connected with each other;

an air bag, being connected to a valve nozzle, such that the outside air being absorbed into the air bag through the valve nozzle, and the air inside the air bag being unable to leak out from the valve nozzle;

if the air bag and the air chamber buffer element being compressed, the air bag and the air chamber buffer element resuming back to the original position when the wearer's foot being lifted and releasing the compression, and the resumability of the highly elastic inner tube of the air chamber buffer element absorbing the outside air into the air bag from the valve nozzle of the air bag, and such repeated compression and resumption saturating the internal air pressure of the air bag and the air chamber buffer element such that the sports shoes definitely having the buffering effect, and offering a repeated use and resuming to its saturated pressure after the air pressure being released, so that the sports shoes at any time and any where having the effect of automatically supplying air until reaching the saturated status without using any additional supply of air or having the risk of air leakage.

2. A buffering device of sports shoes as claimed in claim 1, wherein said inner tube of the air chamber buffer element being made of highly elastic material and providing a better elastic resumability.

* * * * *